US006698033B2

(12) United States Patent
Fujima

(10) Patent No.: US 6,698,033 B2
(45) Date of Patent: Mar. 2, 2004

(54) FACE MASK FOR DIVING

(75) Inventor: Taro Fujima, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 249 days.

(21) Appl. No.: 09/937,034

(22) PCT Filed: Jan. 18, 2001

(86) PCT No.: PCT/JP01/00297

§ 371 (c)(1),
(2), (4) Date: Sep. 21, 2001

(87) PCT Pub. No.: WO01/54970

PCT Pub. Date: Aug. 2, 2001

(65) Prior Publication Data

US 2003/0066124 A1 Apr. 10, 2003

(30) Foreign Application Priority Data

Jan. 28, 2000 (JP) ..... 2000-20307

(51) Int. Cl.[7] ..... A61F 9/02
(52) U.S. Cl. ..... 2/428; 2/426; 2/445
(58) Field of Search ..... 2/426, 428, 439, 2/440, 442, 445, 446; 351/43, 68, 87; D24/110.2; D16/311

(56) References Cited

U.S. PATENT DOCUMENTS

| | | | | | |
|---|---|---|---|---|---|
| 5,329,643 | A | * | 7/1994 | Sato | 2/428 |
| 5,479,917 | A | * | 1/1996 | Hsieh | 128/200.29 |
| 5,564,130 | A | * | 10/1996 | Feng | 2/428 |
| 5,572,989 | A | * | 11/1996 | Lutz et al. | 128/201.18 |
| 5,575,277 | A | * | 11/1996 | Lutz et al. | 128/201.18 |
| 5,860,168 | A | * | 1/1999 | Winefordner et al. | 2/428 |

FOREIGN PATENT DOCUMENTS

| | | |
|---|---|---|
| JP | 8-107947 | 4/1996 |
| JP | 3038946 | 4/1997 |
| JP | 11-253577 | 9/1999 |

* cited by examiner

*Primary Examiner*—Gary L. Welch
(74) *Attorney, Agent, or Firm*—Clark & Brody

(57) ABSTRACT

A diving face mask 1 has a skirt 3 of which a part forms a nose cover 9. The nose cover 9 has a bottom wall 12 configured so that the inner surface of the bottom wall 12 facing nares of a wearer of the mask curves along transversely middle portion 13 of the inner surface so as to protrude inwardly of the nose cover 9 with respect to the portions of the inner surface extending on both sides of the middle portion 13.

3 Claims, 3 Drawing Sheets

FACE MASK FOR DIVING

TECHNICAL FIELD OF THE INVENTION

This invention relates to a diving face mask.

RELATED ART

Japanese Patent Application Laid-open No. 1996-107947 discloses a diving face mask comprising a pair of front lenses, a skirt held by a lens frame on peripheries of the front lenses and extending rearward from the peripheries of the lenses and a head band attached to the lens frame. The skirt is made of flexibly elastic material and includes a nose cover made between the pair of front lenses so as to project forward with respect to the pair of lenses. Nose pinching regions are formed at the both sides of the nose cover. An inner face of a bottom wall of the nose cover opposite to the nares of a wearer of the mask is formed to be flat.

With this face mask of prior art, there is a possibility that the inner face of the bottom wall of the nose cover comes in close contact with the nose from below and closes the nares. Consequently the wearer sometimes has a difficulty to expel a quantity of water within the mask by expiration from the nares.

DISCLOSURE OF THE INVENTION

It is an object of this invention to solve the problem that a nose cover of such a diving face mask of prior art will close the nares of the wearer of the mask.

The object set forth above is achieved, in accordance with this invention, by an improvement in the diving face mask comprising a front lens, a skirt made of flexibly elastic material extending rearward from a periphery of the front lens and a head band to contact a rear peripheral portion of the skirt with the face of the wearer, wherein a part of the skirt forms a nose cover.

The improvement according to this invention is characterized by that the nose cover has a bottom wall configured so that its inner surface facing the nares of the wearer curves along transversely middle portion of the inner surface so as to protrude inwardly of the nose cover with respect to the inner surfaces extending on both sides of the middle portion.

There are preferred embodiments of this invention as follows:

(1) The protruding middle portion extends long in a back and forth direction of the face mask.

(2) The protruding middle portion is prepared by dimensioning a wall thickness of the middle portion to be larger than those of the both sides.

(3) The protruding middle portion is prepared by curving the bottom wall along the middle portion so as to be convex inwardly of the nose cover.

DESCRIPTION OF THE PREFERRED EMBODIMENTS

Details of the diving face mask according to this invention will be more fully understood from the description given hereunder in reference with the accompanying drawings.

Figure 1:
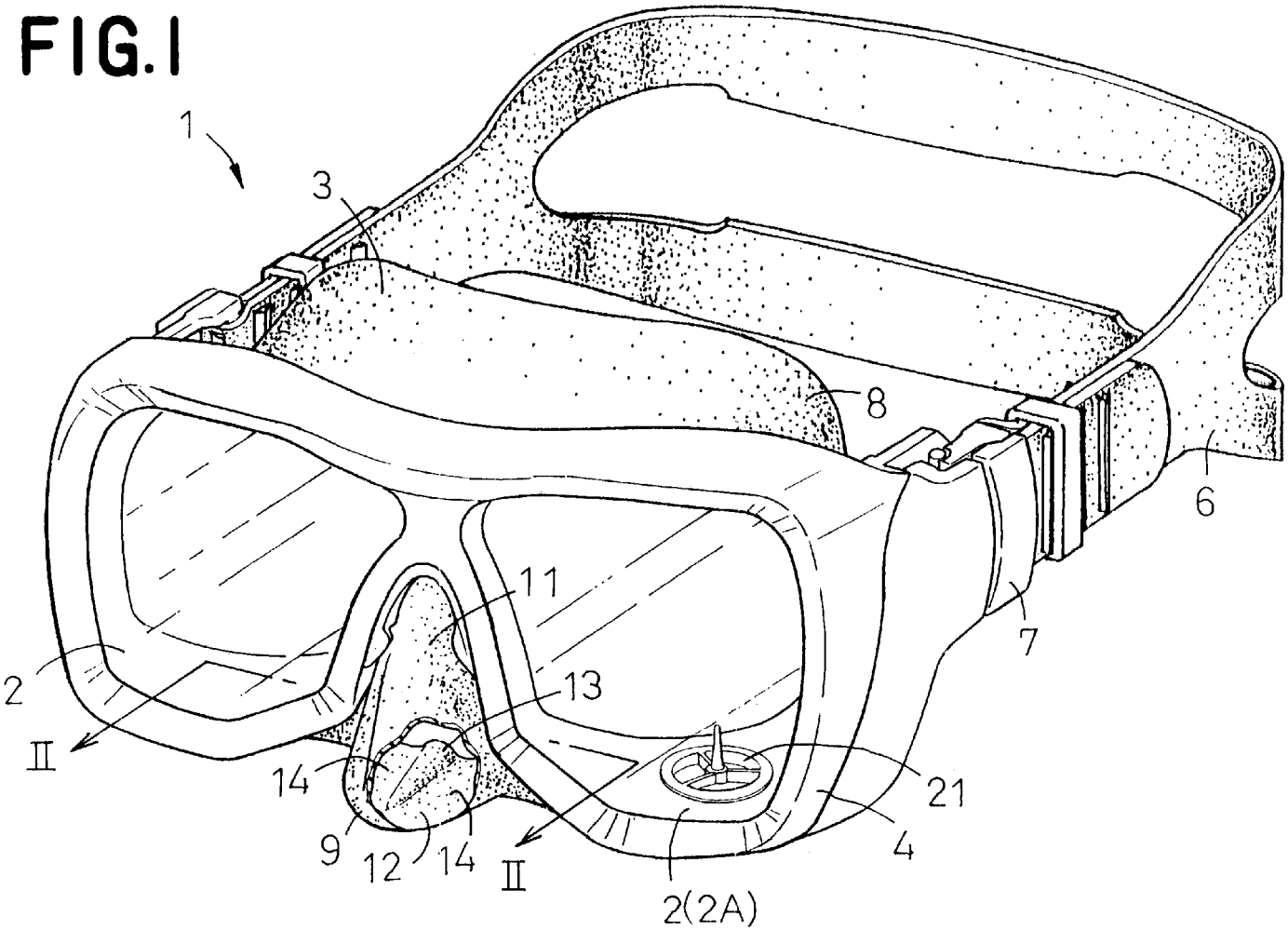
FIG. 1 is a perspective view showing a diving face mask as partially broken away.

A diving face mask shown by FIG. 1 in a perspective view as partially broken away comprises a pair of front lenses 2, a skirt 3 extending rearward from peripheries of the lenses 2, a lens frame 4 holding the skirt 3 on the peripheries of the lenses 2 and a head band 6 guided through buckles 7 rearward from laterally opposite sides of the lens frame 4. The skirt 3 is made of flexibly elastic material such as rubber or plastic elastomer and has a rear peripheral portion 8 to be kept in close contact with the face of a wearer of the mask as the head band 6 is put around his or her head and includes a nose cover 9 formed between the pair of lenses 2 so as to project forward with respect to the pair of lenses 2. The nose cover 9 comprises side walls 11 extending up- and downward as viewed in FIG. 1 and a bottom wall 12 extending generally in the horizontal direction. As will be apparent from the nose cover 9 shown as partially broken away, an inner surface of the bottom wall 12 is formed so that a transversely middle portion 13 of the bottom wall 12 protrudes inward with respect to the portions 14 located on both sides of the middle portion 13. The skirt 3 is provided on its lower part with a non-return valve 21 so that it may be seen through the lens 2 (2A) associated with the left eye. With internal pressure of the mask 1 increased, the non-return valve 21 will be opened outward of the mask 1 and thereby a quantity of water within the mask 1, if any, can be reliably expelled out.

Figure 2:
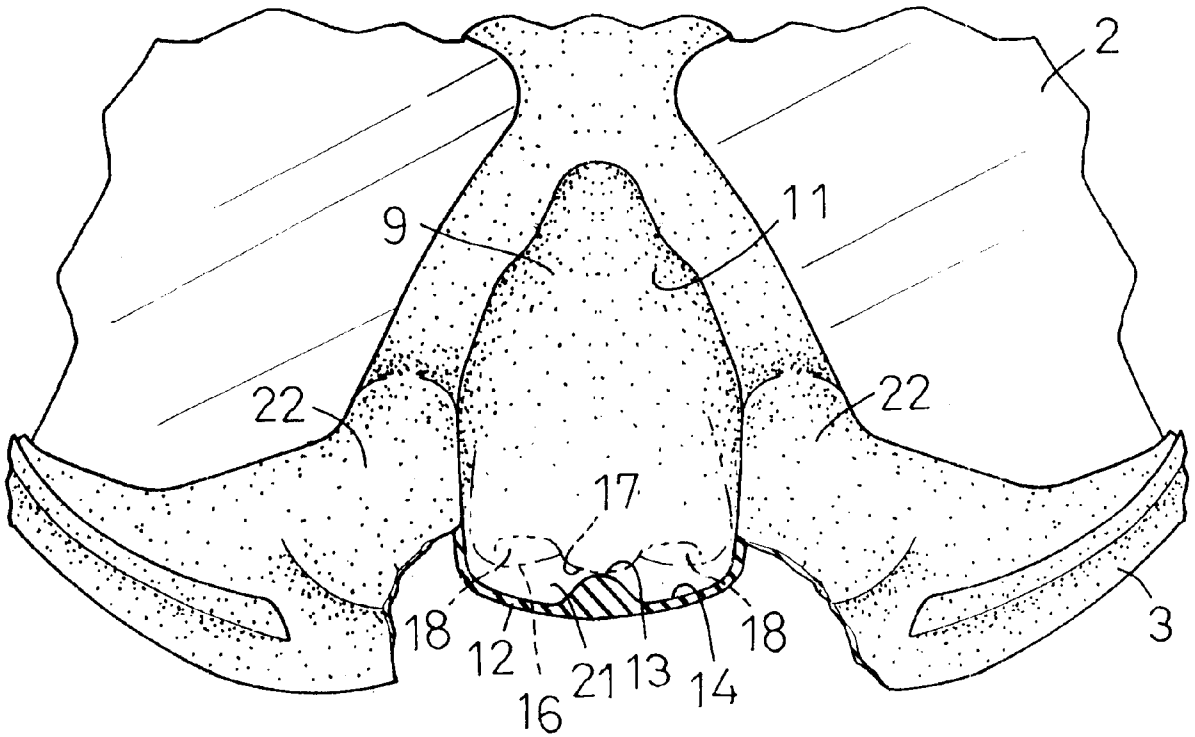
FIG. 2 is a partial view as seen in the direction indicated by arrows II—II of FIG. 1.

FIG. 2 is a partial view as seen in the direction indicated by arrows II—II, in which the bottom wall 12 of the nose cover 9 is shown in a sectional view. The outer contour of the nose 16 of the wearer is indicated by imaginary lines inside the nose cover 9. The middle portion 13 on the bottom wall 12 of the nose cover 9 protrudes so as to describe an arc or inverted V-shape by dimensioning a thickness of this middle portion 13 to be larger than those of the both side portions 14. The middle portion 13 having such a thickness will come in contact from below with the internasal bridge 17 located between the both nares 18 of the wearer's nose 16. When the middle portion 13 comes in contact with the internasal bridge 17, a clearance is ensured between both the nares 18 and the inner surface of the bottom wall 12. In other words, there is no chance that the bottom wall 12 of the nose cover 9 closes the nares 18.

The mask 1 functioning in this manner facilitates and ensures that the no-return valve 21 can be opened by strong expiration from the nose and the quantity of water within the mask 1 can be reliably expelled out.

It is noticed that the skirt 3 has nose pinching means 22 at the positions spaced outward from the both sides of the nose cover 9 as shown in FIG. 2. The nose pinching means 22 are formed by partially depressing the skirt 3 from the exterior to the interior of thereof. The wearer may insert his or her fingers thereinto and pinch his or her nose in order to stop breathing so that the internal pressure and the external pressure of the wearer's ears can be kept in equilibrium with each other.

Figure 3:
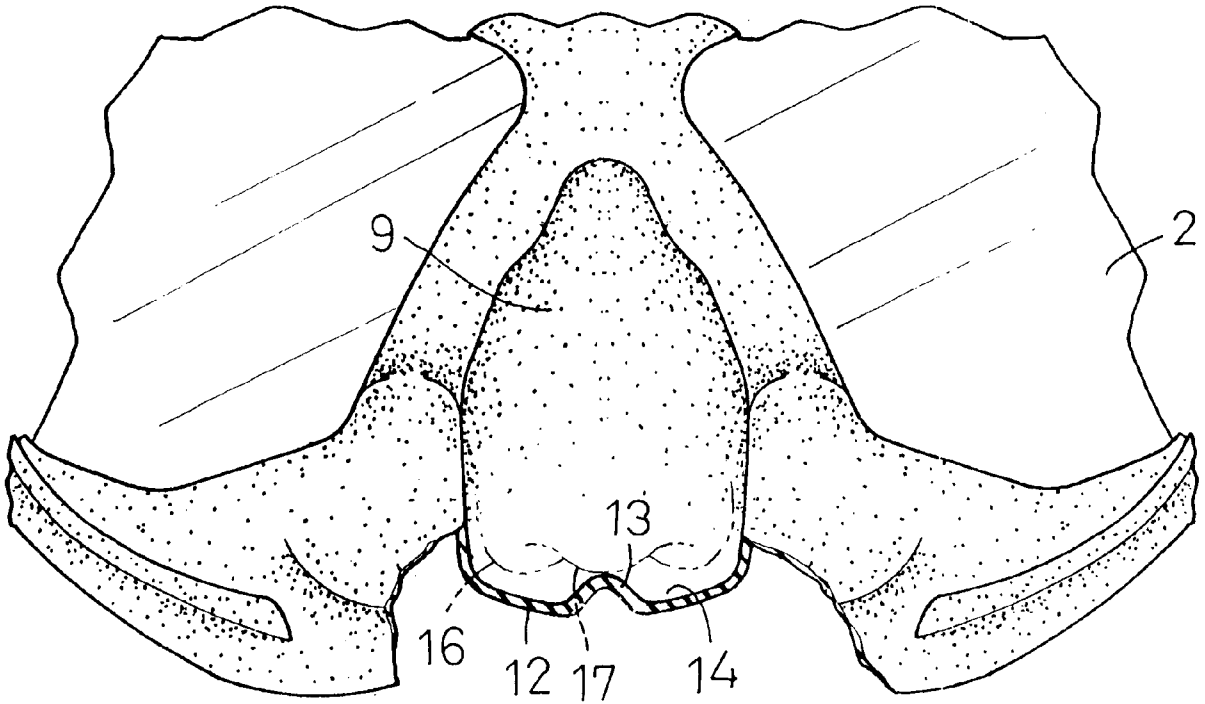
FIG. 3 is a view similar to FIG. 2 but showing an alternative embodiment of this invention.

FIG. 3 is a view similar to FIG. 2 but showing an alternative embodiment of this invention. In this mask 1, the bottom wall 12 is curved so as to be inwardly convex, i.e. to be prominent in the middle portion 13. The nose cover 9 having such a bottom wall also functions in the same manner as in the case of FIG. 2 and is free from a chance that the wearer's nares 18 might be closed by the bottom wall 12.

The diving face mask according to this invention may be implemented without need to provide the no-return valve 21. In the diving face mask, the lenses 2 can be formed of plastic or inorganic glass and head band 6 can be formed of rubber or plastic elastomer.

The diving face mask in the accordance with this invention has the nose cover and the bottom wall of the nose cover protrudes inward in its transversely middle. The middle portion of the bottom wall contributes to form a clearance between both side portions of the bottom wall and the nares of the wearer and thereby avoids a chance that the nares might be closed by the nose cover.

What is claimed is:

1. A diving face mask comprising:

a front lens, a skirt made of flexibly elastic material extending rearward from a periphery of said front lens;

a nose cover formed from part of said skirt and having a bottom wall; and a protrusion formed by partially protruding an inner surface of a middle portion of said bottom wall inwardly of said nose cover, the protrusion extending along the bottom wall and being elongate in a direction generally perpendicular to said front lens.

2. The diving face mask according to claim 1, wherein said protrusion is prepared by dimensioning a wall thickness of the middle portion to be larger than that of the both sides thereof.

3. The diving face mask according to claim 1, wherein said protrusion is prepared by curving said middle portion so as to be convex inwardly of the nose cover.

* * * * *